US006460531B1

(12) United States Patent
Gourley et al.

(10) Patent No.: US 6,460,531 B1
(45) Date of Patent: Oct. 8, 2002

(54) TOY ROCKET LAUNCHER

(76) Inventors: Adam Z. Gourley, P.O. Box 941079, Simi Valley, CA (US) 93094; Gary Paudler, P.O. Box 70, Summerland, CA (US) 93007

( * ) Notice: Subject to any disclaimer, the term of this patent is extended or adjusted under 35 U.S.C. 154(b) by 0 days.

(21) Appl. No.: 09/706,626

(22) Filed: Nov. 6, 2000

Related U.S. Application Data

(60) Provisional application No. 60/163,809, filed on Nov. 5, 1999.

(51) Int. Cl.[7] ..... F41B 11/24
(52) U.S. Cl. ..... 124/64; 124/71
(58) Field of Search ..... 124/59, 63, 64, 124/65, 71, 72

(56) References Cited

U.S. PATENT DOCUMENTS

| | | | | |
|---|---|---|---|---|
| 2,993,297 | A | 7/1961 | Bednar et al. | 46/74 |
| 3,009,453 | A | 11/1961 | Ayala | 124/27 |
| 3,628,416 | A | * 12/1971 | Kernan | |
| 3,752,082 | A | * 8/1973 | Kernan | |
| D248,498 | S | 7/1978 | Kambayashi | D21/1 |
| 4,223,472 | A | * 9/1980 | Fekete et al. | |
| 4,848,307 | A | * 7/1989 | Tsao | |
| 5,323,755 | A | * 6/1994 | Hsieh | |
| D351,432 | S | 10/1994 | Dudeck et al. | D21/82 |
| 5,415,152 | A | 5/1995 | Adamson et al. | 124/59 |
| D368,280 | S | 3/1996 | Brown | D21/3 |
| 5,535,729 | A | * 7/1996 | Griffin et al. | |
| 5,538,453 | A | 7/1996 | Johnson | 446/176 |
| 5,544,642 | A | * 8/1996 | Guthrie | |
| 5,596,978 | A | * 1/1997 | Johnson et al. | |
| 5,680,853 | A | * 10/1997 | Clayton | |
| 6,318,350 | B1 | * 11/2001 | Williams | |

FOREIGN PATENT DOCUMENTS

| | | |
|---|---|---|
| GB | 1 525 621 | 9/1978 |

* cited by examiner

*Primary Examiner*—Michael J. Carone
*Assistant Examiner*—Troy Chambers
(74) *Attorney, Agent, or Firm*—Anthony J. Casella; Gerald E. Hespos

(57) ABSTRACT

A toy rocket launcher includes a rotatable, air pressurized assembly that allows for a plurality of rockets to be launched in sequence. In particular, the assembly uses a ratchet included in a base supporting member, where the ratchet is rotated by a piston included in a launch tube connected between the base supporting member and a source of pressurized air (i.e., a manually-operated bellows). The rockets are disposed on separate launch tubes, the launch tubes open at their terminations and disposed such that each tube will receive, in sequence, the pressurized air supplied by the bellows. A guard ring structure may be included with the launcher to prevent a launch should an individual get too close and disturb the set up.

12 Claims, 5 Drawing Sheets

TOY ROCKET LAUNCHER

CROSS-REFERENCE TO RELATED APPLICATION

This application claims priority from Provisional Application No. 60/163,809, filed Nov. 5, 1999.

BACKGROUND OF THE INVENTION

1. Technical Field

The present invention relates to a toy rocket launcher and, more particularly, to a pressurized air launch assembly for launching a plurality of toy rockets in sequence, including a ratchet mechanism for advancing the to-be-launched rocket into position.

2. Description of the Prior Art

For decades, toy rockets have been popular playthings for children of all ages. Such rockets have been made available in all shapes and sizes. Many models have been provided with their own propellant, such as pressurized water, air, or the like. In general, those propelled by air have been considered the "safest" for young children to use, in that combustible materials, gases and the like are not required to propel the rocket. An exemplary prior art "air propelled" toy rocket and launcher is disclosed us U.S. Pat. No. 2,993,297, issued to W. A. Bednar et al. on Jul. 25, 1961. In this arrangement, an aeronautically balanced missile projectile, cylindrical in shape, is used and provided with tail fins at its rear end. The rocket includes an "impact plug" and nose cone, advantageously formed of a yieldable material, such as sponge rubber, at its forward end.

The launching apparatus for the Bednar et al. apparatus comprises a tube over which the missile fits with a close fit, where the tube comprises a length such that it can be held and aimed by the hand of the operator with the missile in place. The launching apparatus also includes an impact bulb of tough, flexible material adapted to withstand a substantially instantaneous impact by the foot of the operator. Connecting this impact bulb with the launching tube is a flexible tube of sufficient stiffness and strength to withstand a sudden pressure pulse of compressed air without deforming. The Bednar et al. launching apparatus is intended to be used by placing the impact bulb on the ground, holding the launching tube in the hand, and subjecting the bulb to a sudden impact to flatten it and generate the pressure pulse which launches the missile.

A drawback to the Bednar et al. launcher is that the launching tube must be held by the user, limiting the length of the flexible and the potential distance between the impact bulb and the rocket to be launched, which ultimately limits the air pressure that may be available to launch the rocket. U.S. Pat. No. 3,046,694, issued to O. C. Holderer on Jul. 31, 1962, discloses a jet-propelled toy rocket where the launcher comprises a mechanism that rests on the ground. As shown in FIG. 3 of the Holderer et al. patent, a hand-operated air pump is connected to the launch assembly and is used to propel the rocket. The pump includes a cylinder and apertured end cap, with a plunger disposed through the aperture and into the cylinder. A unidirectional ball valve is also provided in the assembly. Thus, to fill the cylinder the plunger is pulled back and then quickly pushed in to launch the rocket.

While the use of a launch assembly as taught by Holderer et al. allows for "remote launching" by a user, a limitation remains in that the launcher is configured to hold and launch only a single rocket.

SUMMARY OF THE INVENTION

The need remaining in the prior art is addressed by the present invention, which relates to a toy rocket launcher and, more particularly, to a pressurized air launch assembly for launching a plurality of rockets in sequence, including a ratchet mechanism for advancing the to-be-launched rocket into position.

In accordance with the present invention, a pressurized air launch assembly includes a top deck which is formed to support a plurality of rockets, each rocket disposed over a launch tube, where an aperture through the top deck is formed at the base of each launch tube. A rotatable launch plate including a single aperture is disposed under the top deck and is configured to rotate with respect to the top deck such that the single aperture will align with sequential launch tube apertures as it is rotated. A base assembly is connected to the rotatable launch plate and comprises a ratchet mechanism for rotating the launch plate with respect to the top deck, where the base assembly also includes a connection to a launch tube and bellows for supplying the pressurized air for rocket launching. A molded stop is included in the base assembly and used to prevent the ratchet from reversing direction.

In a preferred embodiment of the present invention, a guard ring is included in the rocket launch assembly and used to prevent a launch when an individual has come too close to the assembly and disturbed the guard ring. In particular, the guard ring includes a pole disposed through the center of the launch assembly, where the pole then rests upon a spring that will force the pressurized air to air to escape through a central opening in the launch plate aperture if the guard ring is disturbed.

In one embodiment of the present invention, the assembled combination of the top deck, launch plate and base assembly may be tilted so as to provide for an angled launch.

In operation, a piston is included within the launch tube and, as the air enters the base assembly, the piston will engage the ratchet and rotate the ratchet forward one position. The "stop" in the base assembly will prevent the rearward motion of the ratchet. The piece parts are aligned such that when the air is expelled through the tube it will pass through the launch plate aperture, through the launch tube disposed directly above the launch plate aperture and, therefore, launch the rocket.

It is to be understood that any desired number of rocket launch tubes (and associated apertures) may be formed on the top deck of the rocket launch assembly, as long as all of the tubes are disposed on a common circumference and include an aperture that will align with the launch plate aperture upon rotation without causing more than one launch tube to be disposed over the launch plate aperture.

Other and further aspects of the present invention will become apparent during the course of the following discussion and by reference to the accompanying drawings.

BRIEF DESCRIPTION OF THE DRAWINGS

Referring now to the drawings.

DETAILED DESCRIPTION

Figure 1:
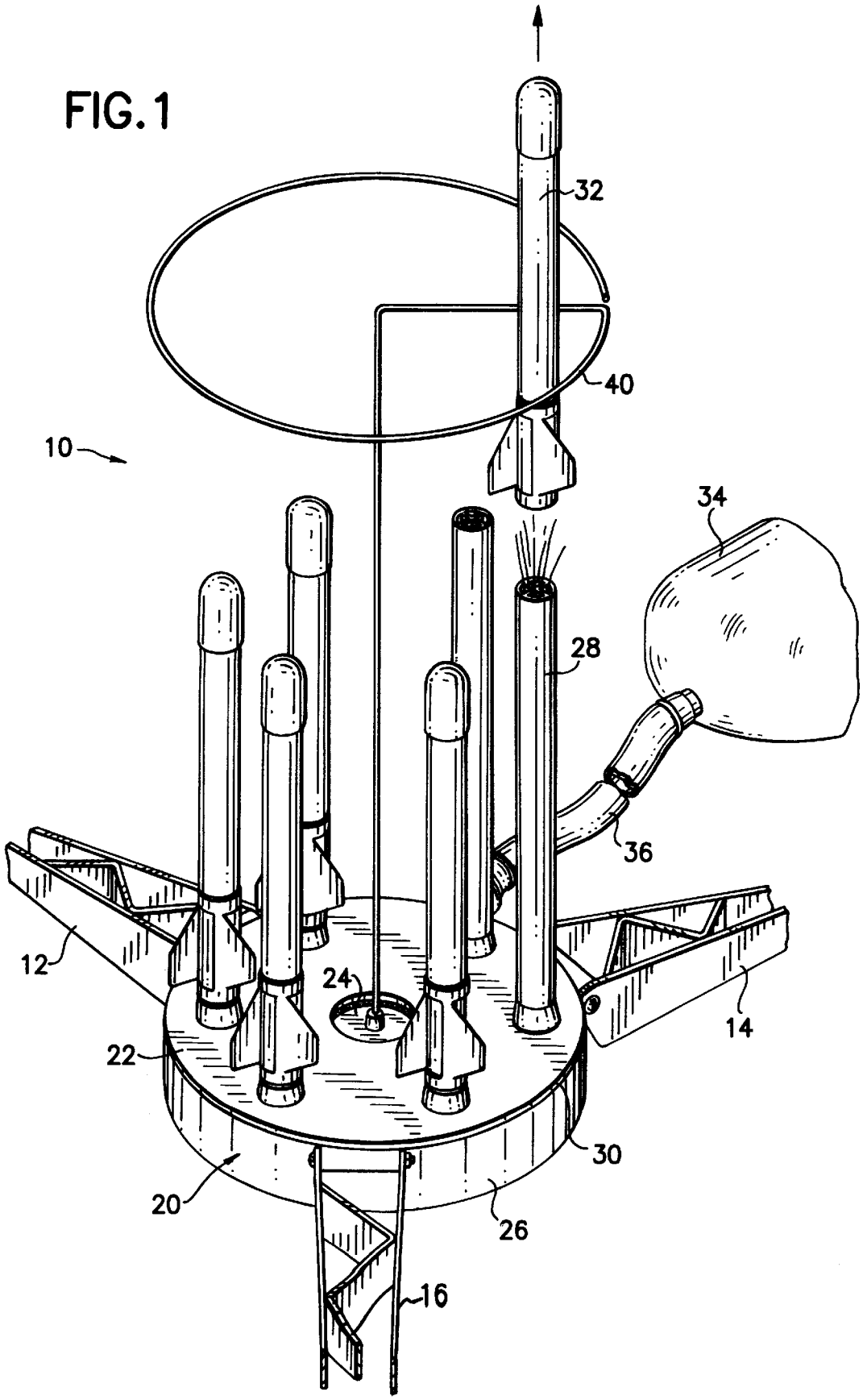
FIG. 1 contains an isometric view of a rocket launch assembly of the present invention, where only a portion of each leg support is illustrated.

An exemplary toy rocket launcher 10 formed in accordance with the present invention is illustrated isometrically in this view. It is to be understood that the plurality of legs 12, 14 and 16 which support launcher 10 are only partially illustrated for the sake of clarity, where legs 12, 14 and 16 are hingeable to allow for easy set up of the launcher. As will be described in greater hereinbelow in association with the remaining drawings, launcher 10 includes a launch subassembly 20 comprising a top deck 22, a launch plate 24 (clearly illustrated in the other figures), and a base assembly 26. A plurality of launch tubes 28 are disposed in a circular pattern on top deck 22 at a predetermined displacement from its periphery 30. As can be seen clearly in the other views, each launch tube 28 includes a bottom opening that will be in communication with launch plate 24 to allow for the pressurized air to be expelled through tube 28 and launch a rocket 32.

A plurality of rockets 32 are thus inserted over the associated plurality of launch tubes 28 where, as will be described in detail below, each rocket 32 may be launched in sequence. The pressurized air used to launch the rocket comes from a bellows 34, connected to launch subassembly 20 by a launch tube 36. In accordance with the present invention, and seen clearly in the following drawings, launch tube 36 includes a piston 38 that engages with launch subassembly 20 to rotate launch plate 24 within subassembly 20 and provide for the sequential launching of each rocket 32.

Also illustrated in FIG. 1 is a guard ring 40 that may be included with rocket launcher 10 to prevent the launching of a rocket when an individual gets too close to launcher 10 and moves the guard ring. As will be described in detail below, as long as guard ring 40 remains in the upright position as shown in FIG. 1, the rockets will launch. However, if guard ring 40 is "bumped" and then is tilted to one side or the other, the launcher will not pressurize and a rocket cannot be launched. The action of an exemplary guard ring 40 of the present invention will be described below in association with FIG. 4.

Figure 2:
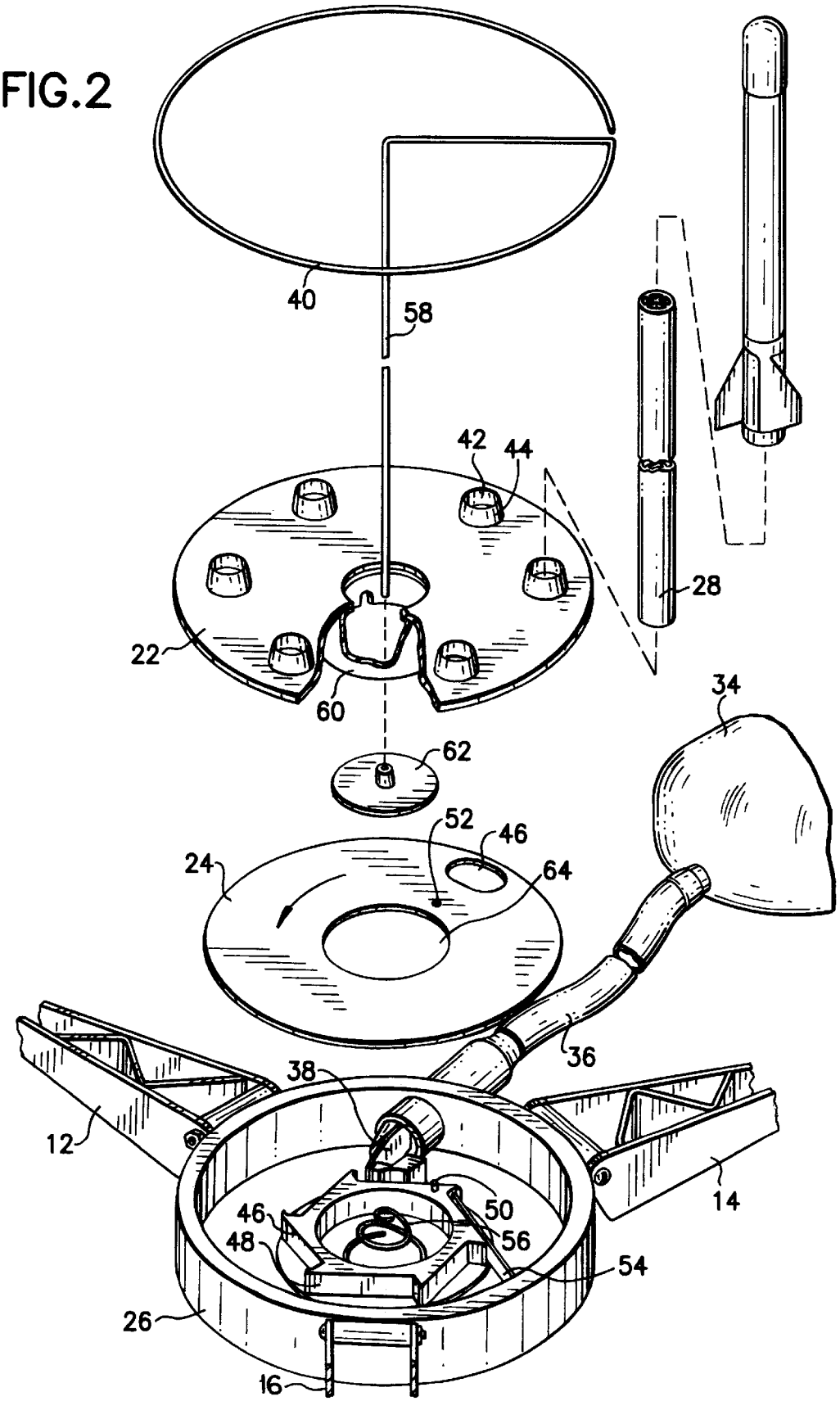
FIG. 2 is an exploded view of the rocket launch assembly of FIG. 1.

An exploded view of launcher 10 of the present invention is shown in FIG. 2. Particularly evident in this view are the detailed components of launch subassembly 20, and the interaction of subassembly 20 with piston 38 of launch tube 36. Referring to FIG. 2, top deck 22 of launch subassembly 20 includes a plurality of mounts 42 for launch tubes 28, where each mount 42 includes a central aperture 44. As launch plate 24 rotates in a manner to be described below, a launch aperture 46 in plate 24 will align, successively, with each mount aperture 44. Therefore, as launch plate 24 rotates (for example, in the counterclockwise direction indicated by the arrow in FIG. 2), each associated rocket 32 will be launched in sequence.

In accordance with the present invention, launch plate 24 is rotated by including a ratchet 47 in base assembly 26, where ratchet 47 includes gear teeth 48 that will engage, in successive movements, piston 38 of launch tube 36. A pin 50 formed on ratchet 47 will fit through a hole 52 formed in plate 24 to mate the two pieces together and allow for them to rotate together. A molded stop 54 is formed in base assembly 24 and is used to rearwardly engage gear teeth 48 so as to prevent backward motion of ratchet 47. As bellows 34 is depressed and air flows through launch tube 36 and enters base assembly 26, piston 38 pushes against an adjacent great tooth 48 and rotates the assembly such that launch aperture 46 will be aligned with the "next available" rocket 32 placed over a launch tube 28. The pressurized air will flow through apertures 46 and 44 and thus launch rocket 32.

Also illustrated in FIG. 2 are the remaining components used with guard ring 40 to prevent launch should an individual be too close to launch assembly 10. In particular, a spring 56 is disposed in the central portion of base assembly 24 and, as shown in FIG. 2, is particularly located in the center of ratchet 47. A post 58 is formed as a downward extension from guard ring 40 and extends through the center of the assembly, and through a sealing member 60 (to prevent the pressurized air from escaping through other apertures), where the bottom of post 58 is secured in a mounting element 62. Mounting element 62 then fits through a central opening 64 in launch plate 24 and rests upon spring 56.

Figure 3:
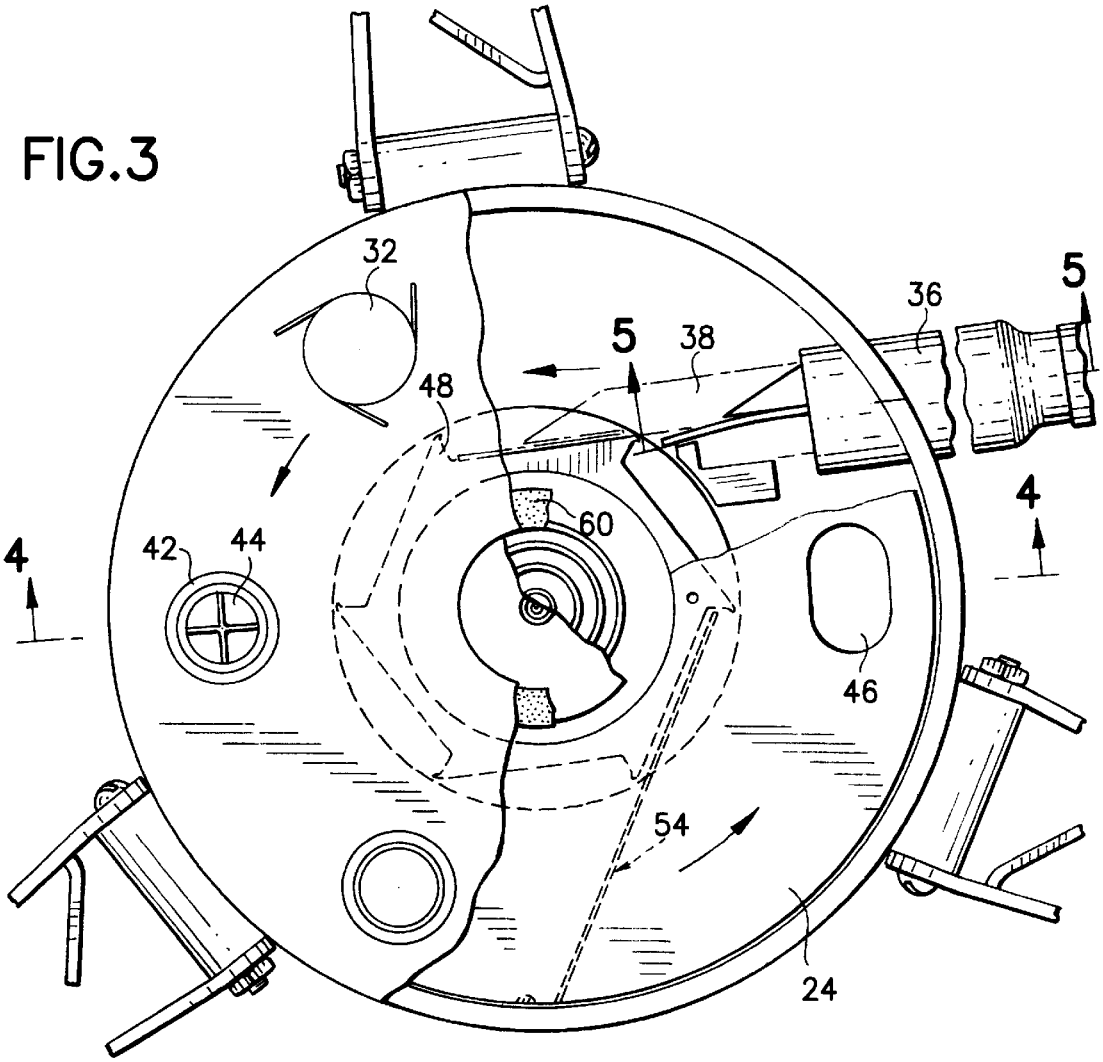
FIG. 3 contains a top view an exemplary rocket launch assembly, with a portion of the top deck removed to particularly illustrate the ratchet-driven forwarding action of the present invention.

A top view of launch assembly 10 of the present invention is illustrated in FIG. 3, which illustrates, in phantom, the movement of piston 38 in to and out of launch tube 36. As shown, when piston 38 exits tube 36 (moving to the left in the particular illustration), a push rod extension 39 on piston 38 will engage with gear tooth 48 to its left, thus rotating the combination of ratchet 47 and launch plate 24 counterclockwise (the rotation in counterclockwise in this example; it is to be understood that with proper re-alignment of the piece parts, a clockwise rotation can also be used). As mentioned above, molded stop 54 is used to engage the back side of a separate gear tooth 48 to prevent backward (in this case, clockwise) motion of ratchet 47.

Figure 4:
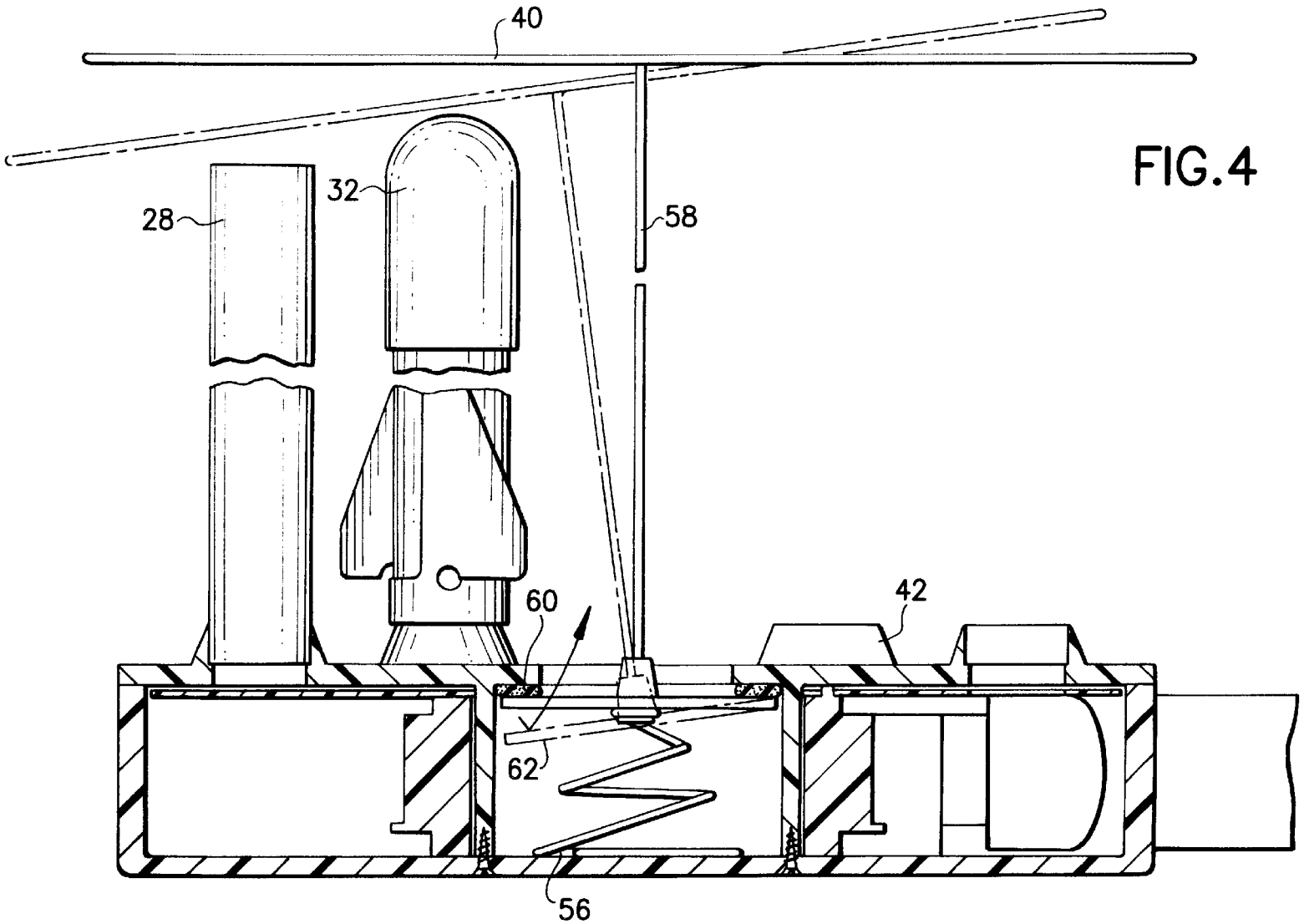
FIG. 4 is a cut-away side view of the launch assembly, taken along line 4—4 of FIG. 3, and particularly illustrating the action of the guard ring feature of the present invention.

FIG. 4 contains a cut-away side view perspective of the arrangement of the present invention, taken along line 4—4 of FIG. 3. Particularly evident in this view (and as shown in phantom), is the movement of guard ring 40 and the associated movement of mounting element 62 to prevent launch. As shown, if guard ring 40 is tilted to one side or the other, this movement will apply a bias to spring 56, and mounting element 62 will also move, as shown in the illustration. In this case, the air-tight seal in the assembly will be broken, and any pressurized air entering base assembly 26 from tube 36 will escape through central opening 64 in launch plate 24, as indicated by the direction of the arrow in FIG. 4. Therefore, if an individual comes too close to the launch assembly and knocks guard ring 40 from its upright position, insufficient air will enter a launch tube 28 (since most of the air will escape through the central region) and rocket 32 will not launch.

Figure 5:
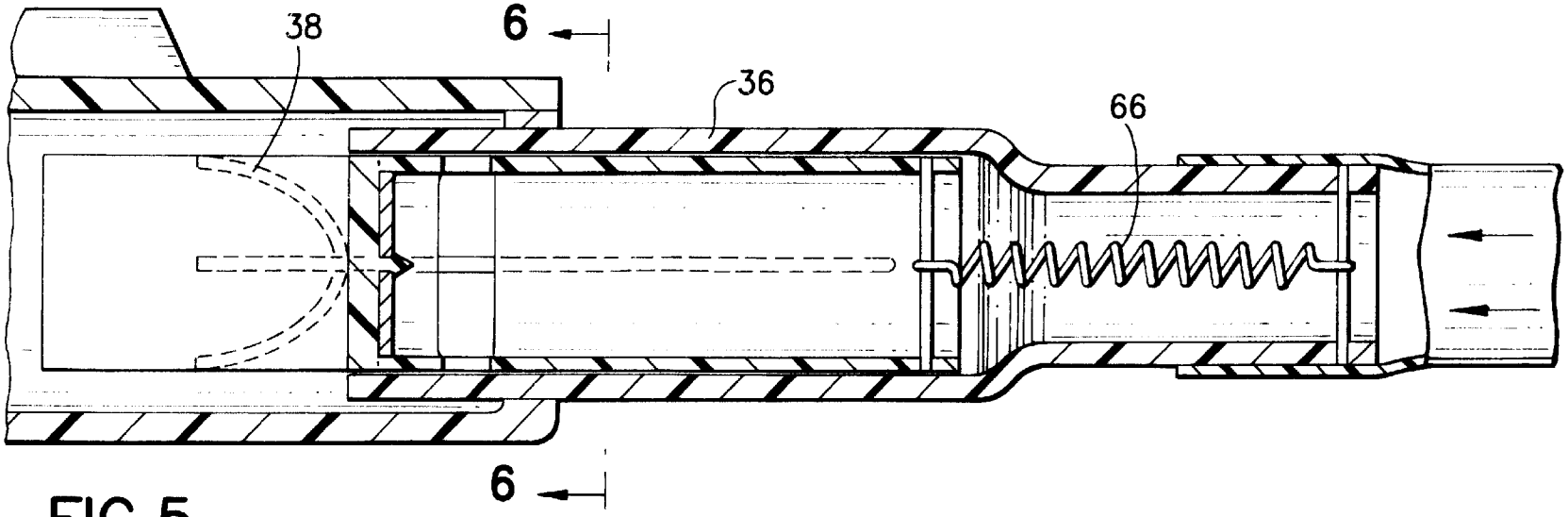
FIG. 5 is a detailed view of the launch tube and piston portion of the present invention, the view taken along line 5—5 of FIG. 3.
Figure 6:
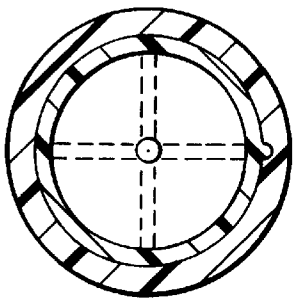
FIG. 6 is a cut-away view of the pressure valve included within the launch tube, the view taken along line 6—6 of FIG. 5.

A cut-away view of a portion of launch tube 36, taken along line 5—5 of FIG. 3, is illustrated in FIG. 5. Clearly evident in this view is a check valve 41 which is disposed within piston 38 and used to prevent the pressurized air from re-entering launch tube 36 and bellows 34. As shown, the action of piston 38 may be controlled through a rod 66 connected to a spring 68, where a base plate 70 of spring 68 receives the air expelled through bellows 34 (not shown). The movement of spring 68 thus results in moving piston 38 and push rod 39 and, in turn, allowing ratchet 47 to rotate and effect the launch of the rocket. An end view of the particular cruciform design of an check valve 41 is shown in FIG. 6.

Figure 7:
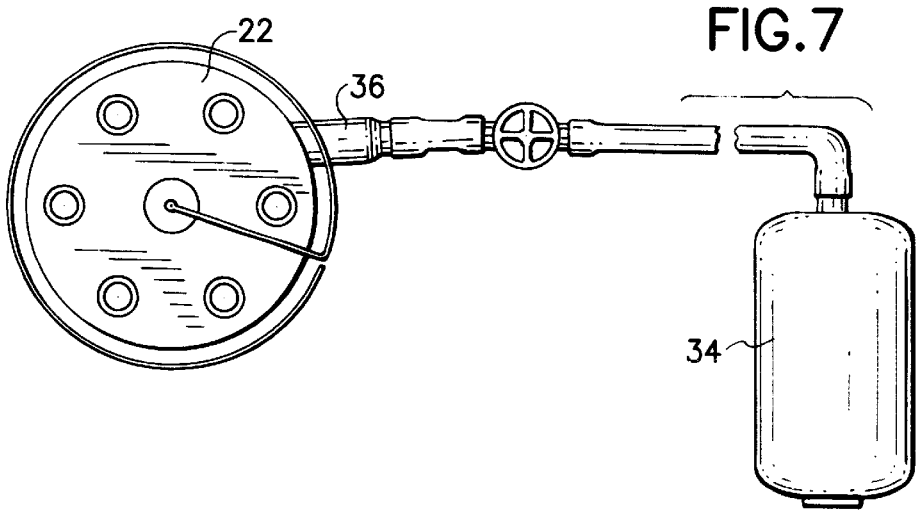
FIG. 7 illustrates two different check valve locations within the assembly of the present invention that allow for air to re-fill the bellows between launches.

Various check valve arrangements may be used to provide for the quick "re-inflation" of bellows 34. FIG. 7 illustrates two different arrangements, the first being a valve 72 disposed along launch tube 36. Alternatively, a check valve 74 may be disposed at the back side 76 of bellows 34. Other arrangements are possible and are considered to fall within the spirit and scope of the present invention.

While there is shown and described herein certain specific structure embodying the invention, it will be obvious to those skilled in the art that various modifications and re-arrangements of the parts may be made without departing from the spirit and scope of the underlying inventive concept and that the same is not limited to the particular forms herein shown and described, except insofar as indicated by the scope of the appended claims.

What is claimed is:

1. An air pressurized toy rocket launch assembly comprising:

a top deck including a plurality of launch tubes disposed in a circular arrangement on said top deck, each launch tube including a bottom aperture through said top deck;

a rotatable launch plate disposed beneath said top deck and including a single launch aperture, said launch aperture aligning, in sequence and upon rotation of said rotatable launch plate, with each launch tube aperture in sequence;

a base assembly for supporting a ratchet, said ratchet attached to said rotatable launch plate and comprising a plurality of gear teeth that are engaged to provide rotation to said ratchet and attached rotatable launch plate;

a launch tube connected to said base assembly and including a piston that exists said launch tube in the presence of pressurized air to engage said gear teeth and rotate said ratchet and attached launch plate; and bellows attached to the opposite said of said launch tube wherein said bellows can be manually operated to expel pressurized air into said launch tube.

2. The air pressurized toy rocket launch assembly as defined in claim 1 wherein the assembly further comprises a plurality of toy rockets including a central opening through the length thereof, each rocket for removably fitting over a separate one of the launch tubes.

3. The air pressurized toy rocket launch assembly as defined in claim 1 wherein the piston includes a push rod for engaging, in sequence, with each gear tooth in the ratchet plurality of gear teeth.

4. The air pressurized toy rocket launch assembly as defined in claim 1 wherein the assembly further comprises a mechanical stop disposed within the base assembly to engage with the gear teeth and prevent backward rotation of the ratchet.

5. The air pressurized toy rocket launch assembly as defined in claim 4 wherein the mechanical stop includes a molded piece part extending inwardly from the periphery of said base assembly to engage a gear tooth behind the gear tooth engaged by the piston.

6. The air pressurized toy rocket launch assembly as defined in claim 5 wherein the molded piece part is positioned to engage the gear tooth immediately behind the gear tooth engaged by the piston.

7. The air pressurized toy rocket launch assembly as defined in claim 1 wherein the piston further comprises a check valve to prevent the pressurized air from re-entering the launch tube.

8. The air pressurized toy rocket launch assembly as defined in claim 1 wherein the launch tube further comprises a valve to allow for reinflation of the bellows.

9. The air pressurized toy rocket launch assembly as defined in claim 1 wherein the bellows further comprises a valve to allow for re-inflation of said bellows after activation.

10. The air pressurized toy rocket launch assembly as defined in claim 1 wherein the assembly further comprises a guard ring subassembly to redirect the flow of pressurized air from the launch tube and through a central opening in said rotatable launch plate and prevent a rocket launch.

11. The air pressurized toy rocket launch assembly as defined in claim 10 wherein the guard ring subassembly comprises:

a circular ring disposed a predetermined distance above the launch assembly top deck;

a central post connected to said circular ring and extending downward through said top deck;

a sealing ring disposed underneath said top deck, wherein said central post extends through said sealing ring;

a mounting post disposed beneath said sealing ring for engaging the termination of said central post; and a spring, disposed on said base assembly in the interior portion of the ratchet, the mounting post resting upon said spring such that when the circular ring is disturbed from its upright position the spring will move, allowing for the mounting post to move away from the rotatable launch plate and allow for pressurized air to escape through the central opening in said rotatable launch plate.

12. The air pressurized toy rocket launch assembly as defined in claim 1 wherein the assembly includes a plurality of legs extending downward from the base assembly to position said assembly above ground level.

* * * * *